United States Patent [19]

Bean et al.

[11] 4,156,643

[45] May 29, 1979

[54] PRODUCTION OF FLUORSPAR HAVING A REDUCED ORGANIC AND CALCIUM CARBONATE CONTENT

[75] Inventors: Samuel L. Bean, Jamesville; Walter R. Buckman, Syracuse, both of N.Y.

[73] Assignee: Allied Chemical Corporation, Morristown, N.Y.

[21] Appl. No.: 707,163

[22] Filed: Jul. 21, 1976

[51] Int. Cl.[2] ..... B03B 7/00

[52] U.S. Cl. ..... 209/12; 209/166; 209/211

[58] Field of Search ..... 209/166, 167, 10, 162, 209/164, 211, 12

[56] References Cited

U.S. PATENT DOCUMENTS

| | | | |
|---|---|---|---|
| 2,615,572 | 10/1952 | Hodge | 209/211 |
| 2,849,930 | 9/1958 | Freeman | 209/211 X |
| 2,936,887 | 5/1960 | Wilson | 209/166 |
| 2,982,409 | 5/1961 | Boadway | 209/211 |
| 3,331,505 | 7/1967 | Mercade | 209/166 X |
| 3,428,175 | 2/1969 | Hukki | 209/168 X |
| 3,430,763 | 3/1969 | Iwasaki | 209/10 |
| 3,430,765 | 3/1969 | Allen | 209/166 X |
| 3,635,337 | 1/1972 | Mercade | 209/166 |

FOREIGN PATENT DOCUMENTS

| | | | |
|---|---|---|---|
| 912081 | 5/1951 | Fed. Rep. of Germany | 209/211 |
| 1150582 | 8/1957 | France | 209/211 |
| 1374894 | 8/1964 | France | 209/10 |

*Primary Examiner*—Robert Halper
*Attorney, Agent, or Firm*—Anthony J. Stewart

[57] ABSTRACT

A concentrated calcium fluoride ore, having a decreased foam value which is particularly adapted for the manufacture of hydrogen fluoride is provided by a process which comprises: (a) grinding calcium fluoride ore containing calcite and quartzite particles to form calcium fluoride particles and to liberate at least a portion of said calcite and quartzite particles; (b) admixing the ground ore with aqueous medium and an effective amount of a suitable flotation agent to form a first aqueous slurry containing said flotation agent and calcium fluoride, calcite and quartzite particles; (c) contacting said first aqueous slurry with a gas under conditions sufficient to produce (i) a foam containing a major portion of said flotation agent and foamed particles comprising calcium fluoride particles together with a minor portion of the calcite and quartzite particles in said first slurry, and (ii) separated solids containing a major portion of the calcite and quartzite particles in said first slurry; (d) recovering at least a portion of said foam containing said foamed particles and said flotation agent portion as a second aqueous slurry; (e) removing from said second slurry a major portion of said foamed particles having a particle size of less than about 10 microns, thereby producing a thickened aqueous slurry containing calcium fluoride particles; and (f) recovering calcium fluoride particles from said thickened aqueous slurry as product.

5 Claims, 2 Drawing Figures

PRODUCTION OF FLUORSPAR HAVING A REDUCED ORGANIC AND CALCIUM CARBONATE CONTENT

BACKGROUND OF THE INVENTION

1. Field of the Invention

This application relates generally to the manufacture of hydrogen fluoride and, more specifically, to a process in which an improved fluorspar feed is provided for hydrogen fluoride manufacture.

2. Description of the Prior Art

It has long been known to produce hydrogen fluoride by reacting calcium fluoride with sulfuric acid in an externally heated rotary furnace. Fluorspar ore is generally employed as the source of the calcium fluoride. However, as naturally occurring fluorspar is generally found combined with other minerals such as calcite (a mineral containing calcium carbonate) and quartzite (a mineral containing silicon dioxide), it is desirable to remove the impurity-minerals to prevent consumption of sulfuric acid in the furnace, which occurs in reactions with calcium carbonate and silicon dioxide, illustrated by the following equations:

$$CaCO_3+H_2SO_4 \quad CaSO_4+CO_2+H_2O \tag{1}$$

$$SiO_2+2CaF_2+2H_2SO_4 \quad SiF_4+2CaSO_4+2\text{-}H_2O \tag{2}$$

The $CO_2$ becomes an impurity in the HF gases produced, and increases problems associated with HF recovery.

One method employed to remove calcite and quartzite impurities from the fluorspar ore involves use of flotation techniques in which the ore is processed by grinding it to a desired degree of fineness, to liberate particles of calcite and quartzite, slurrying the ground ore with water, admixing the slurry with suitable flotation agent and creating a froth from the resulting admixture, as by blowing air through the aqueous ore slurry containing the flotation agent. The flotation agent coats the fluorspar particles, and allows these particles to be collected on the surface as part of the froth. At the same time, most of the liberated calcite and quartzite particles are caused to sink to the bottom of the vessel containing the froth and are discarded. This process results in ore containing as much as 97% by weight or more of calcium fluoride. The froth is removed from the flotation tank vessel, generally by allowing it to overflow the vessel, and is then treated (e.g., by filtration) to recover the concentrated fluorspar solids, which are subsequently dried before being passed for use in hydrogen fluoride manufacture.

While the above flotation techniques have resulted in concentrated fluorspar ore containing less silicon dioxide and calcium carbonate impurities, the presence of residual flotation agent on the dried concentrated fluorspar results in the formation of a foam in the furnace due to the generation in the reaction furnace of HF and carbon dioxide gases, the latter being caused by reaction of any residual calcium carbonate impurities with sulfuric acid.

The foam is highly undesirable. Not only does it reflect loss of raw material as a result of reaction of sulfuric acid and calcium carbonate therewith, but also the foam can cause blockage of gas lines, necessitating complete shutdown of the furnace and substantially reducing unit production. A substantial decrease in heat transfer to the reacting mass from the furnace walls is also caused by the foam, increasing energy requirements. While the volume of foam can be controlled by reducing feed to the furnace, this also reduces productivity of the unit.

This problem has been recognized by the prior art. Note, for example, U.S. Pat. No. 3,878,294 (issued Apr. 15, 1975 to W. Schabacher et al.) which seeks to avoid the problem by heating the fluorspar to a temperature of from 500° to 800° C. using a counterflow of hot gas in order to vaporize any residual flotation agent. However, such a process is undesirable due to the high energy consumption.

The theoretical relationship between certain solids and liquids and the creation in such solid/liquid systems of stabilized foams has been discussed in the literature. See, e.g., J.J. Bikermann, "Surface Chemistry Theory and Applications", p. 378 (2nd ed., Academic Press) (1958) and S. Ross, Chemical Engineering Progress, Vol. 63, No. 9, pg. 41 (1967). It is known that when an imperfectly wetted solid is contacted by a gas bubble the solid is drawn into the interface between the gas and liquid phases, and imparts rigidity to the thin liquid film of the bubble, preventing liquid from draining through the foam layer and stabilizing the foam. Increasing the available surface area of the solid phase increases the foam stability. Thus, the Bikermann reference discloses that coarse galena powder (particle diameter near 0.03 cm.) raised the duration of foam from 17 seconds to 60 seconds and fine galena (particle diameter near 0.01 cm.) to as much as several hours. Bikermann, supra, at p. 378.

However, the art has not investigated the effect particle sizes have upon the stabilization of foams during reaction of calcium flouride ores and sulfuric acid to form hydrogen fluoride.

SUMMARY OF THE INVENTION

According to the present invention, a concentrated calcium fluoride ore, having a decreased foam value which is particularly adapted for the manufacture of hydrogen fluoride is provided by a process which comprises: (a) grinding calcium fluoride ore containing calcite and quartzite particles to form calcium fluoride particles and to liberate at least a portion of said calcite and quartzite particles; (b) admixing the ground ore with aqueous medium and an effective amount of a suitable flotation agent to form a first aqueous slurry containing said flotation agent and calcium fluoride, calcite and quartzite particles; (c) contacting said first aqueous slurry with a gas under conditions sufficient to produce (i) a foam containing a major portion of said flotation agent and foamed particles comprising calcium fluoride particles together with a minor portion of the calcite and quartzite particles in said first slurry, and (ii) separated solids containing a major portion of the calcite and quartzite particles in said first slurry; (d) recovering at least a portion of said foam containing said foamed particles and said flotation agent portion as a second aqueous slurry; (e) removing from said second aqueous slurry a major portion of said foamed particles having a particle size of less than about 10 microns, thereby producing a thickened aqueous slurry containing calcium fluoride particles; and (f) recovering calcium fluoride particles from said thickened aqueous slurry as product.

DESCRIPTION OF THE ACCOMPANYING DRAWINGS

DETAILED DESCRIPTION OF THE INVENTION

Figure 1:
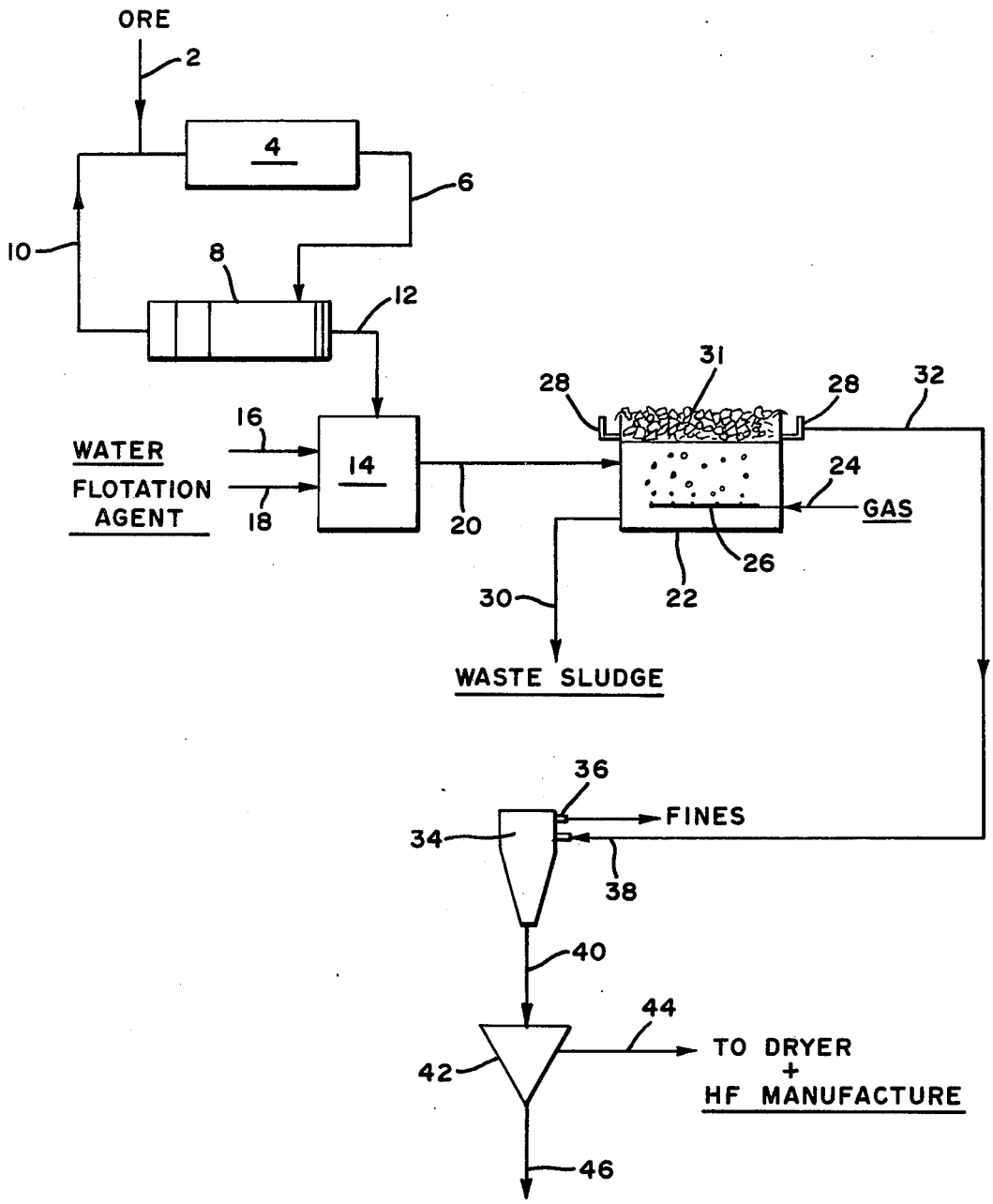
FIG. 1 is a diagrammatic illustration of one embodiment of the process of the present invention.

According to the process of the present invention, calcium fluoride-containing solids are produced having a decreased foam value. As used herein the term "foam value" of a calcium fluoride-containing material refers to the tendency of the material, when contacted with sulfuric acid, to foam under conditions of HF furnaces, and is determined as follows: A sample of the calcium fluoride-containing material, e.g. fluorspar, is dried at a temperature of about 300° F. for a period of from 15 to 20 minutes. The sample is cooled to room temperature and then intimately admixed at a temperature of about 0° C. with $H_2SO_4$, in a $CaF_2/H_2SO_4$ molar ratio of about 1:1. The resulting mixture is placed in a water bath having a temperature of about 50° C., and the volume of foam which develops is measured until the maximum foam volume is attained. The "foam value" is then calculated by the expression $$\text{Foam Value} = \frac{\text{Maximum Volume}}{\text{Initial Volume}} \times 100$$

in which the "Initial Volume" is the volume of the mixture prior to heating. Generally, calcium fluoride-containing materials having a foam value of not greater than about 250 are acceptable for HF furnace operation, while those having foam values greater than about 250 cause increasing operating difficulties and losses of both raw material and product in HF manufacture.

The calcium fluoride ores which may be treated in accordance with the process of the present invention may vary widely in composition, both in terms of their calcium fluoride content and the character and quantities of impurities therein. Typically, however, a calcium fluoride ore (i.e., "fluorspar") will contain from about 40 to 85 weight percent calcium fluoride; from about 3 to 5 weight percent calcite (calculated as calcium carbonate); from about 30 to 40 weight percent quartzite (calculated as silicon dioxide); and from about 6 to 10 weight percent of other impurites such as elemental sulfur, metallic sulfides and phosphates and barium sulfate.

As indicated above, naturally occurring calcium fluoride ore is generally first ground to liberate particles of calcite and quartzite for subsequent separation in the flotation process of these undesired particles from particles of calcium fluoride. The degree to which the calcium fluoride ore is ground may vary widely, depending upon the quantity of impurities in the ore, the efficiency of the furnace in production of HF and other factors. A typical range of particle size distributions of the ground ore is as follows:

| Particle size, microns | Wt. %, Range |
|---|---|
| −5 to +3 | 18 to 20 |
| −10 to +5 | 20 to 50 |
| −20 to +10 | 30 to 50 |
| −40 to +20 | 10 to 15 |
| +40 | 2 to 8 |

The ground ore containing particles of calcium fluoride, calcite and quartzite and impurities is then admixed with water and a suitable flotation agent to form a first aqueous slurry.

The quantity of the ground calcium fluoride ore employed in the first aqueous slurry is not critical and may vary widely. Typically, however, the first aqueous slurry contains the ground ore in an amount of from about 30 to 60 weight percent and preferably from about 40 to 50 weight percent. Of course, the quantity of calcium fluoride, calcite and quartzite particles in the first aqueous slurry will depend on the extent to which the ore was ground, the calcium fluoride ore's original composition, and other factors, in addition to the amount of the ground ore introduced to the first aqueous slurry. As used herein, the term "calcium fluoride particles" is intended to refer to particles containing calcium fluoride and impurities obtained from the above grinding step. While the grinding liberates quantities of calcite and quartzite particles present in the calcium fluoride ore, it should be understood that the calcium fluoride particles may also contain residual calcite and quartzite, in addition to other impurities, although in lesser amounts than present in the original ore. For example, calcium fluoride particles containing about 97 weight percent calcium fluoride may also contain from from about 0.5 to 1.5 weight percent calcite (calculated as calcium carbonate), from about 1.0 to 2.0 weight percent quartzite (calculated as silicon dioxide) and from about 0.05 to 0.2 weight percent of other impurities present in the original ore.

Flotation agents which may be employed are conventional and their description is not critical at the present invention. Thus, suitable flotation agents are as described in U.S. Pat. No. 3,430,765 (issued in 1969 to G. E. Allen, et al.) and include saturated and unsaturated fatty acids, such as saturated fatty acids having from 4 to 22 carbon atoms (e.g. oleic acid, linoleic acid and stearic acid) and unsaturated fatty acids having from 18–22 carbon atoms. The quantity of flotation agents employed in the first aqueous slurry is not critical and may vary widely depending on such factors as the amount of calcite and quartzite particles in the ground ore, the particle size distribution of the ground ore and other factors. Generally, however, flotation agent is introduced into the aqueous slurry in an amount of from about 0.01 to 0.3 weight percent, and preferably from about 0.1 to 0.25 weight percent.

The pH of this first aqueous slurry which may be used to achieve maximum flotation in the subsequent step is known to the art and may be effected employing conventional techniques, such as are described in U.S. Pat. No. 3,430,765.

The first aqueous slurry is treated in a conventional manner to create a foam. A gas (e.g., air) which is not reactive with any component of the first aqueous slurry may be passed through the slurry under conditions of temperature, pressure and gas flow rate sufficient to create the desired foam. While not critical to the present invention, the first aqueous slurry is generally foamed at its boiling temperature. Typically, the slurry is foamed in a vessel provided with an upper open end. Gas is sparged to the liquid in the lower part of the vessel, and the foam is allowed to collect on the liquid surface. The foam may be allowed to overflow the vessel and flow into a trough provided about the circumference of the vessel's upper end. The vessel may also be provided with rotating arms which rotate horizontally over the liquid surface to assist in removing the foam therefrom. Upon removal from the foaming vessel, the foam generally breaks up spontaneously to form a slurry (herein termed the "second aqueous slurry" containing calcium fluoride particles and particles of calcite, quartzite and other impurities which collect in the foam. The percentage of calcite and quartzite in the calcium fluoride ore which is removed as solids in the flotation vessel may vary widely depending on the amount of flotation agent employed, the amount of calcium fluoride, calcite and quartzite particles in the first aqueous slurry, and other factors. However, generally up to about 90 weight percent of the calcite (calculated as calcium carbonate), and generally up to about 95 weight percent of the quartzite (calculated as silicon dioxide) in the first aqueous slurry settles to the bottom of the flotation vessel and is, hence, removed from the first aqueous slurry. These settled solids may be removed from the flotation vessel and passed to waste. Thus, the foam and the second aqueous slurry generally contains foamed particles in an amount of generally less than about 2 weight percent, and preferably less than about 1 weight percent of the calcite (calculated as calcium carbonate) and generally less than about 2 weight percent, and preferably less than about 1 weight percent of the quartzite (calculated as silicon dioxide) contained in the first aqueous slurry, and also generally contains at least about 90 weight percent, and preferably at least about 95 weight percent of the calcium fluoride (calculated as $CaF_2$) contained in the first aqueous slurry. The foam and subsequent second aqueous slurry also contain a major portion (i.e. at least 50 weight percent and preferably at least about 70 weight percent, of the flotation agent contained in the first aqueous slurry. The precise amounts present will vary depending on the quantity and type of flotation agent employed and a variety of other factors.

The foam or second aqueous slurry spontaneously formed therefrom is then treated to remove a major portion, i.e., at least 50 weight percent, and preferably at least 70 weight percent, of solids having a particle size of less than about 10 microns, and more preferably less than about 5 microns. It has been found that these fines may be conveniently removed from this slurry by passing the slurry to a liquid cyclone in which the slurry is subjected to rapid vortex motion which results in a separation of fines as overhead and the formation of a thickened slurry as underflow, which may be subsequently treated to recover calcium fluoride therefrom.

It has been found that removal of the above fines results in a removal with the fines of a substantial portion (generally at least about 50 weight percent, and preferably at least about 70 weight percent) of flotation agent in the second aqueous slurry, and preferably results in a thickened slurry generally containing less than about 0.2 weight percent, and preferably less than about 0.1 weight percent flotation agent.

Reference is now made to FIG. 1 wherein one embodiment of the present invention is illustrated. Calcium fluoride ore is passed via line 2 to grinding apparatus 4 in which the ore is ground to a desired fineness. The ground ore is withdrawn via line 6 and passed, optionally, to classifier 8 in which the ground ore is separated to remove any undesired coarse fraction which is recycled to grinder 4 via line 10, and the feed ground ore of the desired particle size which is withdrawn from classifier 8 via line 12 and passed to vessel 14. In vessel 14, the feed ground ore is admixed with water, introduced therein via line 16, and flotation agent, introduced therein via line 18, to form a first aqueous slurry which is withdrawn via line 20 and passed to flotation vessel 22. Gas (e.g., air) is sparged into the liquid contained in vessel 22 via line 24 and sparging apparatus 26, thereby producing foam 31 at the surface of the liquid. Foam 31 is allowed to overflow vessel 22 for collection by troughs 28 positioned circumferentially about vessel 22 below the upper rim thereof. Foam 31 contains foamed particles, comprising calcium fluoride particles together with a minor portion of the calcite and quartzite particles in the first aqueous slurry and a major portion of the flotation agent in the first aqueous slurry. Solids not incorporated into the foam settle to the bottom of vessel 22 and are withdrawn to waste via line 30. These solids contain a major portion of the calcite and quartzite particles present in the first aqueous slurry. The foam collected in troughs 28 generally breaks up spontaneously to form a second aqueous slurry, which is withdrawn and passed via line 32 to solids separation apparatus, for example, liquid cyclone 34, for treatment of the second aqueous slurry to remove therefrom a major portion of the particles having a particle size of less than 10 microns. The second aqueous slurry is introduced via line 38 to cyclone 34, thereby resulting in an overhead (withdrawn via line 36) containing the major portion of calcite particles present in the second aqueous slurry and a thickened underflow slurry (withdrawn via line 40) containing calcium fluoride particles. The thickened underflow slurry is passed to subsequent solid separation, for example, filter 42, in which solids are withdrawn and passed via line 44 to subsequent treatment, including drying and passing of the dried solids to HF manufacture. Liquid withdrawn from filter 42 via line 46 may be recycled to vessel 14 in which ground ore is slurried.

Figure 2:
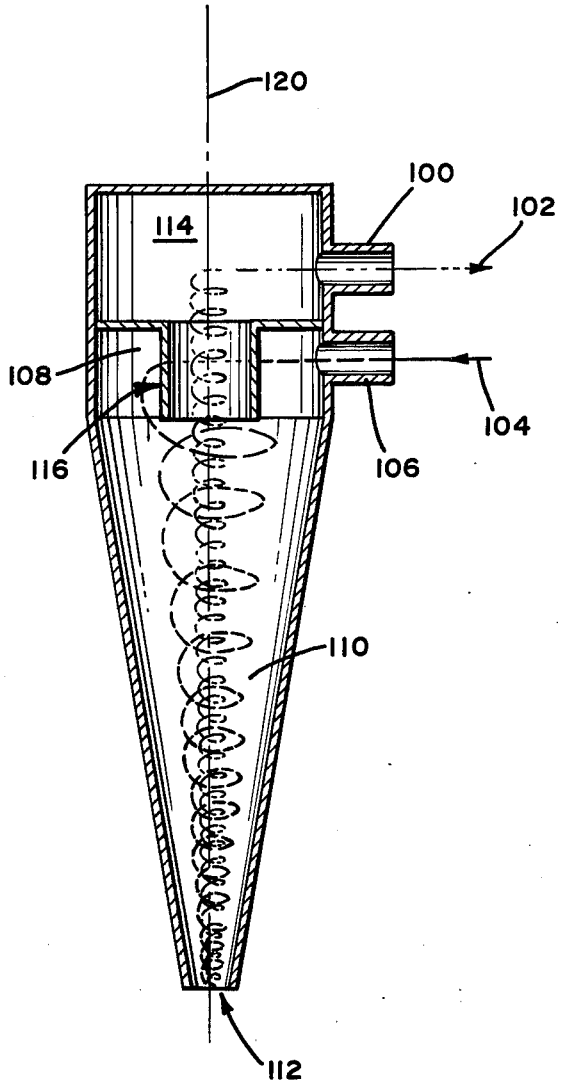
FIG. 2 is a cross-sectional view of a liquid cyclone used in the preferred embodiment of the process of the present invention.

Although the liquid cyclone may be of conventional construction, and a detailed discussion of its structure is not essential to the present invention, FIG. 2 shows a typical such cyclone. The apparatus in FIG. 2 comprises an elongated housing provided with cylindrical upper section 108 and conical lower section 110 communicating therewith. Inlet 106 is provided for the tangential introduction of the second aqueous slurry containing calcium fluoride, calcite and quartzite particles and flotation agent at a high velocity causing it to whirl rapidly in the chamber 108. From chamber 108 the slurry flows in a continuously whirling stream down along the conical wall of lower section 110 in a path of ever decreasing radius and therefore increasing velocity. The centrifugal forces created cause an outward motion of the particles by an amount dependent upon their specific gravity, shape and dimensions. The particles susceptible to separation by this force are thrown out toward the wall of the conical section and collect at the bottom of chamber 110 where they are discharged through apex opening 112. As the whirling stream approaches the bottom of conical section 112, it is constrained to flow in toward center axis 120 and then up and out through vortex finder tube 116 into upper chamber 114 from which it is withdrawn via outlet 100 as stream 102. The thickened slurry is removed via outlet 112 from the bottom of chamber 110.

The invention may be further illustrated by reference to the following examples:

EXAMPLE

An aqueous slurry is prepared containing 25 weight percent ground calcium fluoride ore containing 97.2 weight percent calcium fluoride, 0.33 weight percent calcite (calculated as calcium carbonate), 1.6 weight percent quartzite (calculated as silicon dioxide) and 0.3 weight percent impurities (i.e. flotation agent, metallic sulfides, phosphates, etc.). This aqueous slurry is pumped at a rate of about 20 gallons per minute through a Whirlstream Model 110 liquid cyclone (manufactured by Polyclon, Inc.) and having the general configuration shown in FIG. 2. Samples of the overflow and thickened underflow are taken and analyzed for residual organic flotation agent, calcium carbonate, foam value and total solids. The results of these analyses are set forth in Table I below:

TABLE I

| Analysis (Dry Basis) | Aqueous Slurry Feed | Overflow | Underflow |
|---|---|---|---|
| Weight Percent Total Solids | 25 | 9 | 75 |
| Weight Percent $CaCO_3$ | 0.33 | 1.09 | 0.15 |
| Weight Percent Total Organic | 0.20 | 0.34 | 0.09 |
| Foam Value | 320 | 614 | 241 |

Table II below compares the particle size distribution for solids in the overflow and underflow from the cyclone with the particle size distribution of the ground ore present in the starting aqueous slurry, and also reflects the relative amounts of each particle size which passes into the overflow and underflow streams.

TABLE II

| Particle Size Range (Microns) | Aqueous Slurry Feed (Wt.%) | Overhead Stream | | Underflow Stream | |
|---|---|---|---|---|---|
| | | Wt.% of Sample | Wt.% of Feed in Overhead | Wt.% of Sample | Wt.% of Feed in Underflow |
| −5 to +3 | 8.8 | 14.0 | 3.9 | 6.8 | 4.8 |
| −10 to +5 | 41.7 | 74.5 | 20.9 | 29.0 | 20.8 |
| −20 to +10 | 36.4 | 11.4 | 3.1 | 46.3 | 33.3 |
| −40 to +20 | 10.8 | <0.1 | <0.03 | 15.0 | 10.8 |
| +40 | 2.3 | — | — | 2.9 | 2.3 |

As can be seen from the above results, removal of about 28 percent of the starting ground ore and about 93 weight percent of the water in the aqueous slurry produced a thickened underflow containing calcium fluoride values which when passed to an HF furnace for manufacture of HF results in a substantially decreased quantity of foam and, hence, an improved operating performance of the furnace.

While there had been described various embodiments of the invention, the methods described are not intended to be understood as limiting the scope of the invention as it is realized that changes there within are possible and it is further intended that each element where cited in any of the following claims is to be understood as referring to all equivalent elements for accomplishing the same results in substantially the same or equivalent manner, it being intended to cover the invention broadly in whatever form it's principle may be utilized.

We claim:

1. A process for producing a concentrated calcium fluoride ore having a decreased foam value which is particularly adapted for the manufacture of hydrogen fluoride, which comprises:

(a) grinding calcium fluoride ore containing calcite and quartzite particles to form calcium fluoride particles and to liberate at least a portion of said calcite and quartzite particles; (b) admixing the ground ore with aqueous medium and an effective amount of a suitable flotation agent to form a first aqueous slurry containing said flotation agent and calcium fluoride, calcite and quartzite particles; (c) contacting said first aqueous slurry with a gas under conditions sufficient to produce (i) a foam containing a major portion of said flotation agent and foamed particles comprising calcium fluoride particles together with a minor portion of the calcite and quartzite particles in said first slurry, and (ii) separated solids containing a major portion of the calcite and quartzite particles in said first slurry; (d) recovering at least a portion of said foam containing said foamed particles and said flotation agent portion as a second aqueous slurry; (e) removing from said second aqueous slurry a major portion of said foamed particles having a particle size of less than about 10 microns, thereby producing a thickened aqueous slurry containing calcium fluoride particles; and (f) removing calcium fluoride particles from said thickened aqueous slurry as product.

2. The process according to claim 1 wherein said second aqueous slurry is treated to remove at least about 70 weight percent of said foamed particles having a particle size less than about 10 microns.

3. The process according to claim 1 wherein at least 50 weight percent of flotation agent in said second aqueous slurry is removed with said major portion of foamed particles having a particle size of less than about 10 microns.

4. The process according to claim 1 wherein said thickened aqueous slurry contains less than about 0.2 weight percent flotation agent.

5. The process according to claim 1 wherein said second aqueous slurry is treated for removal of a major portion of said foamed particles having a particle size of less than about 5 microns.

* * * * *